US008227066B2

(12) United States Patent
Gentsch et al.

(10) Patent No.: US 8,227,066 B2
(45) Date of Patent: Jul. 24, 2012

(54) ANNULAR DISC OF BENT SHEET MATERIAL

(75) Inventors: Dietmar Gentsch, Bochum (DE); Georg Ptaschek, Limeshain (DE)

(73) Assignees: Umicore AG & Co. KG, Hanau-Wolfgang (DE); ABB Technology AG, Zurich (CH)

( * ) Notice: Subject to any disclaimer, the term of this patent is extended or adjusted under 35 U.S.C. 154(b) by 595 days.

(21) Appl. No.: 11/660,614

(22) PCT Filed: Aug. 19, 2005

(86) PCT No.: PCT/EP2005/008998

§ 371 (c)(1),
(2), (4) Date: May 19, 2008

(87) PCT Pub. No.: WO2006/018313

PCT Pub. Date: Feb. 23, 2006

(65) Prior Publication Data

US 2008/0282501 A1 Nov. 20, 2008

(30) Foreign Application Priority Data

Aug. 19, 2004 (DE) ..... 10 2004 040 311

(51) Int. Cl.
*F16L 57/00* (2006.01)
*B21D 28/00* (2006.01)

(52) U.S. Cl. ..... 428/64.1; 16/108; 72/332; 228/56.3; 428/596; 428/599; 428/604; 428/687

(58) Field of Classification Search ..... 16/108; 72/332; 228/56.3; 428/64.1, 596, 599, 603, 428/604, 687
See application file for complete search history.

(56) References Cited

U.S. PATENT DOCUMENTS 3,021,593 A 2/1962 Cousino (Continued)

FOREIGN PATENT DOCUMENTS

DE 337 6/1952

(Continued)

OTHER PUBLICATIONS

International Search Report (PCT/EP2005/008998).

(Continued)

*Primary Examiner* — Gerard Higgins
*Assistant Examiner* — Sathavaram I Reddy
(74) *Attorney, Agent, or Firm* — Kalow & Springut LLP

(57) ABSTRACT

The invention relates to an annular disc of bent sheet material (21) with at least one junction at which the annulus is closed. Furthermore, a method for producing an annular disc is disclosed, comprising the steps of: (a) providing a sheet material; (b) bending the sheet material into an annular disc; (c) severing the sheet material, so that an annular disc with a junction at which the annulus is open is provided; (d) closing the junction, so that an annular disc with a junction at which the annulus is closed is provided. A description is given of a method for producing an annular disc comprising the steps of: (i) providing a sheet material; (ii) bending the sheet material into a first part of an annular disc; (iii) severing the sheet material, so that a first part of an annular disc is provided; (iv) repeating steps (i), (ii) and (iii) at least once, so that at least one further part of the annular disc is provided; and (v) connecting the first part and the further parts of the annular disc, so that an annular disc with at least two junctions at which the annulus is closed is provided.

13 Claims, 3 Drawing Sheets

U.S. PATENT DOCUMENTS

| | | | | |
|---|---|---|---|---|
| 4,996,111 | A * | 2/1991 | Do-Thoi et al. | 428/432 |
| 6,101,701 | A * | 8/2000 | Potocnik et al. | 29/417 |
| 6,102,382 | A * | 8/2000 | Labesky | 267/161 |

FOREIGN PATENT DOCUMENTS

| | | |
|---|---|---|
| EP | 0 823 566 A2 | 11/1998 |
| GB | 1585733 | 3/1981 |
| JP | 11047976 A | 2/1999 |
| JP | 2004202499 | 7/2004 |

OTHER PUBLICATIONS

Written Opinion (PCT/EP2005/008998).
International Preliminary Report on Patentability (PCT/EP2005/008998).

* cited by examiner

ANNULAR DISC OF BENT SHEET MATERIAL

FIELD OF THE INVENTION

The present invention relates to an annular disc of bent sheet material and to a method for producing it.

BACKGROUND OF THE INVENTION

It is known to produce annular discs by punching out the desired form from a wide sheet. With this punching method, however, only a small part of the sheet used is processed into annular discs. For instance, in industrially customary methods, generally only between 10% and 40% of the sheet used is actually processed into annular discs. The rest remains as scrap and must be reprocessed into sheet before possible reuse, with the great effort and costs that involves. Therefore, methods in which a greater part of the material used is processed into the annular discs are desired.

SUMMARY OF THE INVENTION

The present invention relates to an annular disc of bent sheet material with at least one junction at which the annulus is closed.

A further embodiment of the invention is a method for producing an annular disc, comprising the steps of:

(a) providing a sheet material;
(b) bending the sheet material into an annular disc;
(c) severing the sheet material, so that an annular disc with a junction at which the annulus is open is provided;
(d) closing the junction, so that an annular disc with a junction at which the annulus is closed is provided.

Furthermore, the invention relates to a method for producing an annular disc, comprising the steps of:

(i) providing a sheet material;
(ii) bending the sheet material into a first part of an annular disc;
(iii) severing the sheet material, so that a first part of an annular disc is provided;
(iv) repeating steps (i), (ii) and (iii) at least once, so that at least one further part of the annular disc is provided; and
(v) connecting the first part and the further parts of the annular disc, so that an annular disc with at least two junctions at which the annulus is closed is provided.

DETAILED DESCRIPTION OF THE PREFERRED EMBODIMENTS

Figure 1A:
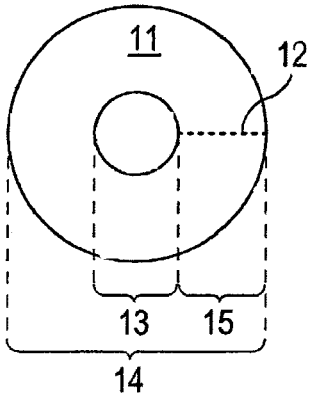
FIG. 1 shows annular discs according to the invention with one, two and three junctions.
Figure 1B:
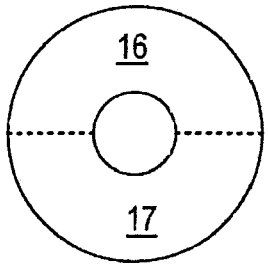
Figure 1C:
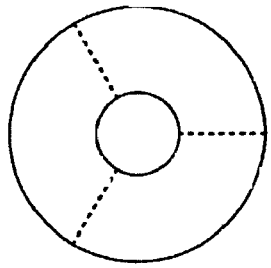

Annular discs according to the invention are shown in FIG. 1. In FIG. 1A, the annular disc 11 has one junction 12. The annular disc is characterized by an inside diameter 13, an outside diameter 14 and a web width 15. In FIG. 1B, a further annular disc according to the invention with two junctions is shown. Although in FIG. 1B the first part of the annular disc 16 and the second part of the annular disc 17 are represented as both being of the same size, this is merely preferred. It is likewise possible to assemble the annular disc from parts of different sizes. In FIG. 1C, an annular disc according to the invention with three junctions is shown.

The annular discs according to the invention have at least one junction. The number of junctions is not particularly restricted and there are generally one to four junctions. Annular discs with two to four junctions are particularly preferred, more preferred with two junctions, since there is less of a tendency towards bulging and buckling during the bending of parts of annular discs that there is during the bending of complete annular discs which require only one junction.

In the case of both methods according to the invention, firstly a sheet material is provided. The sheet material is generally an elongated material in strip form, the width, thickness and length of which are not particularly restricted. The sheet material has a width which corresponds to the web width of the annular disc to be produced. Typical widths are from 0.5 mm to 15 mm, preferably 2 mm to 10 mm. The thickness of the sheet material likewise corresponds essentially to the desired thickness of the annular disc. It may vary for example from 0.005 mm to 0.30 mm, preferably from 0.15 mm to 0.20 mm. The minimum length of the sheet material is not restricted, provided that the sheet material is at least long enough for an annular disc or part of an annular disc to be formed from it. The maximum length of the sheet material is not restricted, since pieces of the desired length can be obtained from a long strip by severing after bending. The sheet material is generally used as roll stock. However, it is likewise possible to use short strips.

The sheet material may consist of any desired material which can be formed into an annular disc by the method according to the invention. The sheet material preferably comprises a metal or a metal alloy, such as for example solder material, iron or grades of steel. With regard to the extensibility of the sheet material, sheet materials with a Vickers hardness of at most HV1 170 are preferably used, more preferably HV1 100 to HV1 150. The Vickers hardness can be measured as specified in DIN 50133.

In a particularly preferred embodiment of the invention, the sheet material consists of solder material, in particular of a hard solder material. Hard solder materials are, for example, solder materials which have a melting point of at least 450° C. They can be used to produce connections that are sealed with respect to a high vacuum, for example in the case of vacuum interrupters. These soldered connections can withstand high loading and can ensure sealing with respect to a high vacuum of $10^{-7}$ mbar over at least 20 years. Silver-copper based hard solder alloys (such as $Ag_{72}CU_{28}$ and $Ag_{69.7}Cu_{28}Ge_2Co_{0.3}$) and silver-copper-palladium-based hard solder alloys (such as $Ag_{68.4}Cu_{26.6}Pd_5$, $Ag_{65}Cu_{20}Pd_{15}$ and $Ag_{54}Cu_{21}Pd_{25}$) may be mentioned as examples of a hard solder material.

Figure 2:
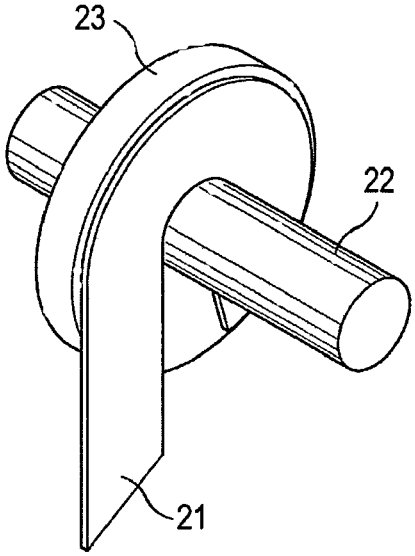
FIG. 2 shows a possible device for bending the sheet material.

The sheet material provided is bent into an annular disc or part of an annular disc. In a preferred embodiment, as shown in FIG. 2, the sheet material 21 is wound on edge around a bar 22. The diameter of the bar should in this case correspond essentially to the inside diameter of the desired annular disc. The diameter of the bar is not particularly restricted and is typically 25 mm to 290 mm, preferably 40 mm to 140 mm.

Figure 3:
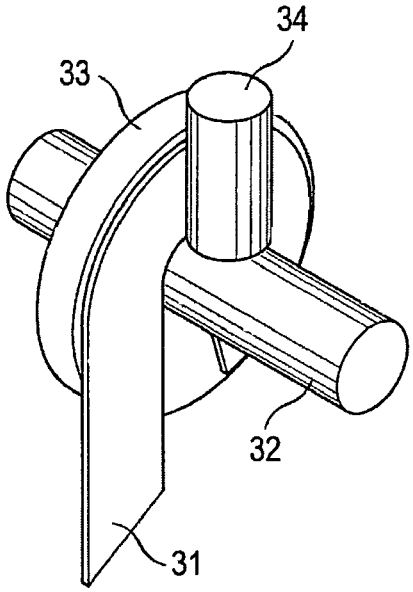
FIG. 3 shows a further possible device for bending the sheet material.
Figure 4:
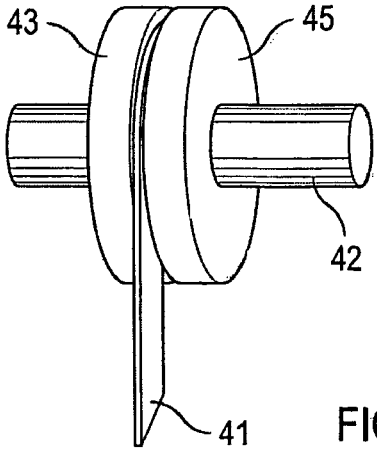
FIG. 4 shows another embodiment of a device for bending the sheet material.

In order to prevent the annular disc or the part of the annular disc becoming non-planar during bending, since the sheet material 21 bulges or buckles for example, the sheet material 21 may for example lie on a plate 23 attached to the bar 22 during the bending operation. If required, the contact with the plate may be assisted in various ways. For example, it would be possible to feed the sheet material 21 in at a suitable angle, so that it lies in contact or, as shown in FIG. 3, a pressing roller 34 or other corresponding device may be used. A further possible way of guiding the sheet is represented in FIG. 4. Here, the sheet material 41 is guided between two circular discs 43 and 45, which are fastened to the bar 42. If appropriate, the guidance of the strip may also be provided by a plate which is not attached to the bar or a device which is separate from the bar. In this embodiment, too, the planarity of the annular disc can be assisted by corresponding further measures or devices.

Figure 5:
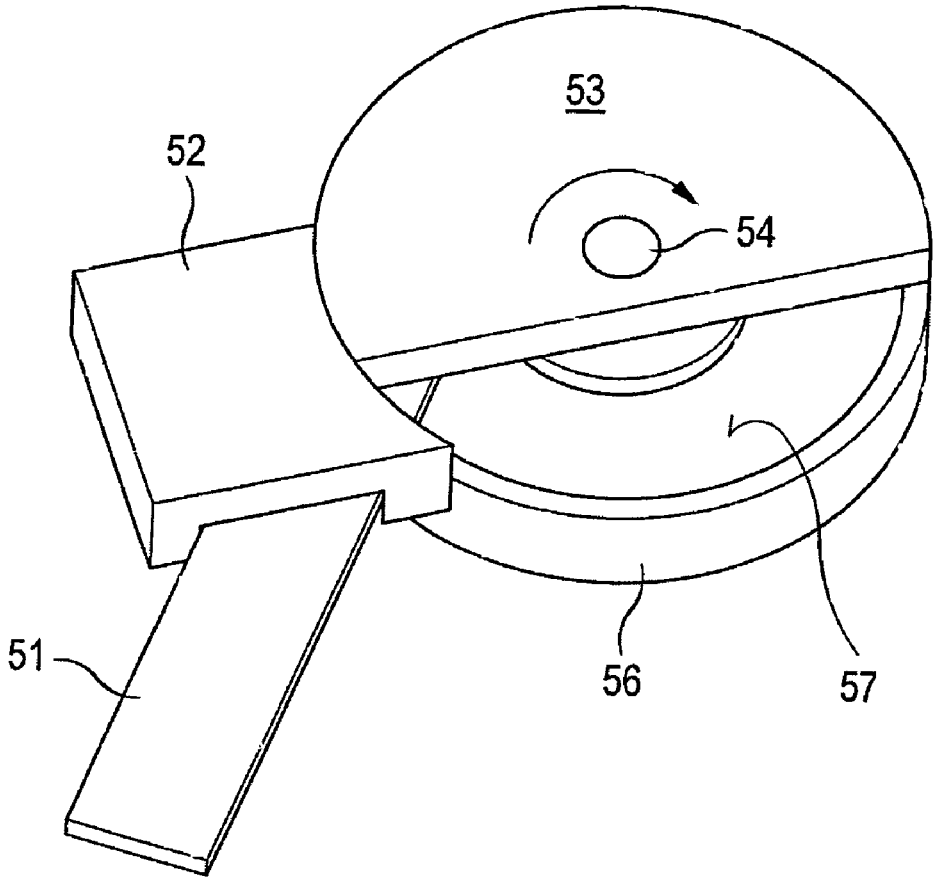
FIG. 5 shows yet a further possible device for bending the sheet material.

FIG. 5 shows a further device for bending the sheet material. The sheet material 51 is fed in by means of a guide 52 in such a way that it is guided in a depression 57 in a lower plate 56. An upper plate 53, which is mounted rotatably about a bar 54, also guides the sheet material.

Figure 6:
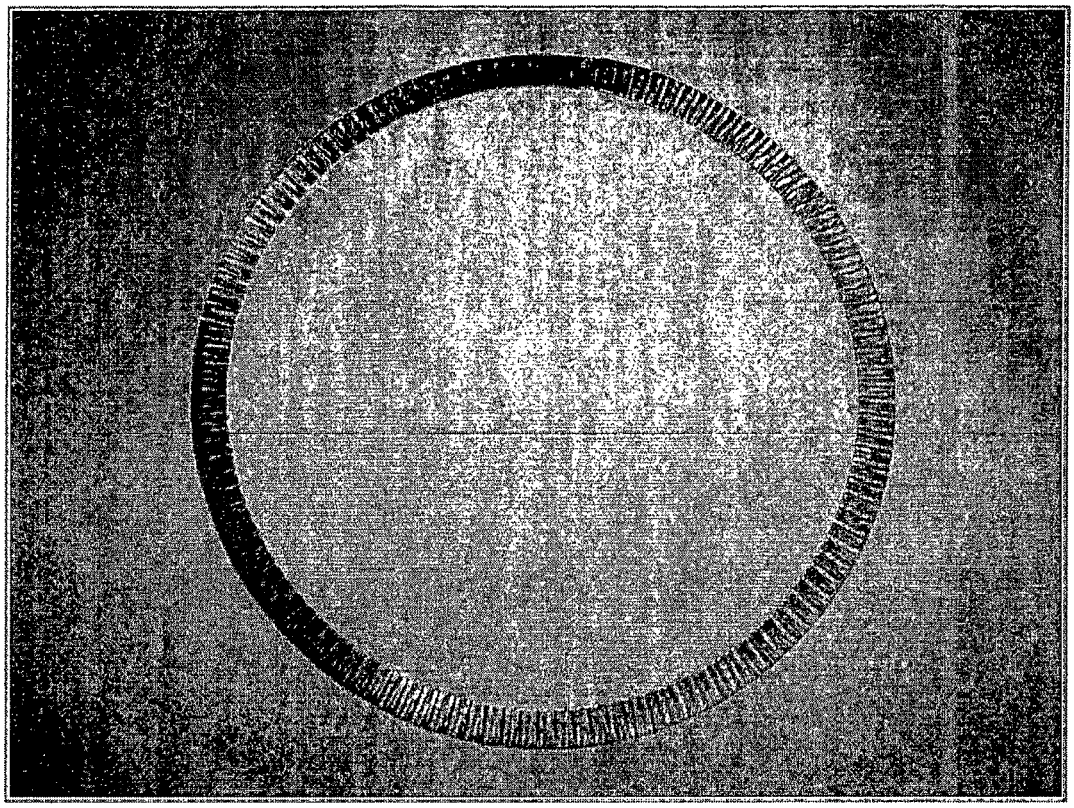
FIG. 6 shows an annular disc according to the invention.

It is possible that, with the method according to the invention, annular discs which have slight bulges transversely to the web width are obtained (FIG. 6). These bulges do not adversely influence the use of the annular discs, in particular when they are used as solder material.

After the bending of the annular disc or the first part of the annular disc, the sheet material is severed. In the case of the second embodiment of the method according to the invention, in which the annular disc is made up of a number of parts, the steps (i), (ii) and (iii) described above are subsequently repeated, thereby providing one or more further parts of the annular disc, which can be joined together to form a complete annular disc.

In a final method step, the junction or junctions of the inner disc is or are connected, so that a complete annular disc is provided. The methods for connecting the junctions are not particularly restricted. Generally, the method for connecting the junctions is suitably selected on the basis of the sheet material used. Soldering and welding, in particular resistance welding and laser welding, can be mentioned as possible methods.

An annular disc which has been bent, but the junction of which is not connected, is disadvantageous. Since the junction is not connected, the two ends of the sheet material at the junction can move away from each other during production, mounting or use, so that the annular disc is no longer planar. Moreover, such annular discs are disadvantageous because the open junction can become hooked with other annular discs, the devices used, storage containers and the like, and the hooked annular disc subsequently has to be laboriously unhooked again manually.

What is claimed is:

1. An annular disc formed by bending a sheet material, wherein the annular disc has at least one junction at which an annulus is closed, wherein the sheet material is a hard solder material being selected from silver-copper-based hard solder alloys and silver-copper-palladium-based hard solder alloys and wherein the at least one junction is connected by soldering or welding, and said annular disc has a plurality of bulges disposed transversely to a web width of the annular disc.

2. The annular disc according to claim 1, the annular disc having two junctions at which the annulus is closed.

3. The annular disc according to claim 1, wherein the sheet material has a Vickers hardness of up to HV1 170.

4. The annular disc according to claim 2, wherein the sheet material has a Vickers hardness of up to HV1 170.

5. The annular disc according to claim 1, wherein the hard solder material is selected from $Ag_{72}Cu_{28}$, $Ag_{69.7}Cu_{28}Ge_2Co_{0.3}$, $Ag_{68.4}Cu_{26.6}Pd_5$, $Ag_{65}Cu_{20}Pd_{15}$ and $Ag_{54}Cu_{21}Pd_{25}$.

6. The annular disc according to claim 2, wherein the hard solder material is selected from $Ag_{72}Cu_{28}$, $Ag_{69.7}Cu_{28}Ge_2Co_{0.3}$, $Ag_{68.4}Cu_{26.6}Pd_5$, $Ag_{65}Cu_{20}Pd_{15}$ and $Ag_{54}Cu_{21}Pd_{25}$.

7. The annular disc according to claim 3, wherein the hard solder material is selected from $Ag_{72}Cu_{28}$, $Ag_{69.7}Cu_{28}Ge_2Co_{0.3}$, $Ag_{68.4}Cu_{26.6}Pd_5$, $Ag_{65}Cu_{20}Pd_{15}$ and $Ag_{54}Cu_{21}Pd_{25}$.

8. A method for producing a soldered connection, the method comprising providing an annular disc according to claim 1, and soldering the annular disc to a connection to provide a high vacuum seal.

9. A method according to claim 8, wherein the soldered connection is used in a vacuum interrupter.

10. A method for producing a soldered connection, the method comprising providing an annular disc according to claim 2 and soldering the annular disc to a connection to provide a high vacuum seal.

11. A method for producing a soldered connection, the method comprising providing an annular disc according to claim 3 and soldering the annular disc to a connection to provide a high vacuum seal.

12. A method for producing a soldered connection, the method comprising providing an annular disc according to claim 4 and soldering the annular disc to a connection to provide a high vacuum seal.

13. A method for producing a soldered connection, the method comprising providing an annular disc according to claim 5 and soldering the annular disc to a connection to provide a high vacuum seal.

* * * * *